US007115548B1

(12) United States Patent
Yamaguchi et al.

(10) Patent No.: US 7,115,548 B1
(45) Date of Patent: Oct. 3, 2006

(54) HIGH-DENSITY DETERGENT COMPOSITION

(75) Inventors: Shu Yamaguchi, Wakayama (JP); Hideichi Nitta, Wakayama (JP); Kyoko Okada, Wakayama (JP); Kimihiro Mizusawa, Wakayama (JP); Jun Kozuka, Wakayama (JP); Toshiharu Noguchi, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/889,497

(22) PCT Filed: Jan. 14, 2000

(86) PCT No.: PCT/JP00/00145

§ 371 (c)(1),
(2), (4) Date: Jul. 18, 2001

(87) PCT Pub. No.: WO00/42162

PCT Pub. Date: Jul. 20, 2000

(30) Foreign Application Priority Data

Jan. 18, 1999 (JP) ..... 11-009946
Jun. 16, 1999 (JP) ..... 11-170144

(51) Int. Cl.
*C11D 17/06* (2006.01)
*C11D 3/08* (2006.01)

(52) U.S. Cl. ..... 510/276; 510/444; 510/351; 510/356; 510/357; 510/507; 510/511

(58) Field of Classification Search ..... 510/276, 510/444, 351, 356, 357, 507, 511
See application file for complete search history.

(56) References Cited

U.S. PATENT DOCUMENTS

| | | | | | |
|---|---|---|---|---|---|
| 3,925,228 | A | * | 12/1975 | Cheng | 510/351 |
| 4,102,823 | A | * | 7/1978 | Matheson et al. | 510/351 |
| 4,291,071 | A | * | 9/1981 | Harris et al. | 510/331 |
| 4,411,803 | A | * | 10/1983 | Wixon | 510/331 |
| 4,549,977 | A | * | 10/1985 | Joshi et al. | 8/137 |
| 4,970,017 | A | * | 11/1990 | Nakamura et al. | 510/441 |
| 5,610,131 | A | * | 3/1997 | Donoghue et al. | 510/444 |
| 5,698,510 | A | * | 12/1997 | Wilkinson et al. | 510/444 |
| 5,866,531 | A | * | 2/1999 | Assmann et al. | 510/446 |
| 5,958,864 | A | * | 9/1999 | Artiga Gonzalez et al. | 510/443 |
| 5,998,357 | A | * | 12/1999 | Appel et al. | 510/444 |
| 6,069,124 | A | * | 5/2000 | Appel et al. | 510/438 |
| 6,156,718 | A | * | 12/2000 | Donoghue et al. | 510/444 |
| 6,191,095 | B1 | * | 2/2001 | Emery et al. | 510/438 |
| 6,262,010 | B1 | * | 7/2001 | Emery et al. | 510/446 |
| 6,284,722 | B1 | * | 9/2001 | Yamaguchi et al. | 510/357 |
| 6,294,512 | B1 | * | 9/2001 | Mort, III et al. | 510/438 |
| 6,376,453 | B1 | | 4/2002 | Kubota et al. | 510/438 |
| 6,521,585 | B1 | * | 2/2003 | Yamashita et al. | 510/444 |
| RE38,411 | E | * | 2/2004 | Yamaguchi et al. | 8/137 |

FOREIGN PATENT DOCUMENTS

| | | | |
|---|---|---|---|
| EP | A1229671 | | 7/1987 |
| EP | A2466484 | | 1/1992 |
| EP | A 1578871 | | 1/1994 |
| JP | A 61-231098 | | 10/1986 |
| JP | A 61-231099 | | 10/1986 |
| JP | A 63-150392 | | 6/1988 |
| JP | A 63-154799 | | 6/1988 |
| JP | A 63-199797 | | 8/1988 |
| JP | A 64-20297 | | 1/1989 |
| JP | A 64-20298 | | 1/1989 |
| JP | A 2-154000 | | 6/1990 |
| JP | A 4-253800 | | 9/1992 |
| JP | 6-2000 | A | 1/1994 |
| JP | 6-279797 | A | 10/1994 |
| JP | A 11-35998 | | 2/1999 |
| WO | WO 93/25378 | | 12/1993 |
| WO | WO 94/02573 | A1 * | 2/1994 |
| WO | A1 99/29829 | | 6/1999 |
| WO | A1 99/29830 | | 6/1999 |
| WO | WO 99/28433 | | 6/1999 |
| WO | A1 99/36503 | | 7/1999 |
| WO | A1 99/63047 | | 12/1999 |

* cited by examiner

*Primary Examiner*—Lorna M. Douyon
(74) *Attorney, Agent, or Firm*—Birch, Stewart, Kolasch & Birch, LLP

(57) ABSTRACT

A high-density detergent composition comprises 10 to 60% by weight of a surfactant composition having a weight ratio of an anionic surfactant to a nonionic surfactant of 4:10 or more and 10:0 or less, wherein the high-density detergent composition has a bulk density of from 600 to 1200 g/L, and has a total summation of a product of a mass base frequency Wi and a dissolving rate Vi of each group of classified granules obtained by classifying detergent granules by using a classifier, which satisfies the following formula: $\Sigma(Wi \cdot Vi) \geqq 95(\%)$, and wherein a mass base frequency of the classified granules having a size of less than 125 μm is 0.1 or less, wherein the classifier comprises sieves each having a sieve-opening 2000 μm, 1410 μm, 1000 μm, 710 μm, 500 μm, 355 μm, 250 μm, 180 μm, and 125 μm, and a receiver.

11 Claims, 1 Drawing Sheet

( 1 )

( 2 )

HIGH-DENSITY DETERGENT COMPOSITION

This application is the national phase under 35 U.S.C. § 371 of PCT International Application No. PCT/JP00/00145 which has an International filing date of Jan. 14, 2000, which designated the United States of America and was not published in English.

TECHNICAL FIELD

The present invention relates to a high-density detergent composition and a process for preparing the same.

BACKGROUND ART

While increasing the density of the powdery detergent composition has imparted great advantages in the improvement in the transportation efficiency and the convenience in the users, there is an increasing concerning on the dissolubility by compression of the detergent granules.

While since the mid 1990's, the washing machines have the tendency of having large volume capacity and water conservation by the demands of users, and short-period washing mode or gentle stirring mode meeting the demands of reduction in clothes damaging has been set. However, in either of the modes, the amount of work (i.e. mechanical power×time) of the washing machine tends to be lowered. As a result, there arise crucial problems that the dissolubility of the detergent granules is drastically lowered, so that the detergency becomes poor and that the insoluble remnants deposit on clothes.

On the other hand, Japanese Unexamined Patent Publication Hei 7-509267 discloses a detergent composition comprising a base powder comprising granules having a size of less than 150 μm in an amount of less than 10% by weight, and granules having a size exceeding 1700 μm in an amount of less than 10% by weight; and filler granules made of sodium citrate, sodium hydrogencarbonate, or the like. However, the detergent composition does not sufficiently solve the problems relating to the dissolubility and the dispersibility of the detergent composition in a case where the amount of work of the washing machine is low.

An object of the present invention is to provide a high-density detergent composition which is excellent in the detergency even when the amount of work of the washing machine is low, excellent in the dissolubility of the granules and the dispersibility, and excellent also in the hand-washing dissolubility. The above object and other objects of the present invention will be apparent from the following description.

DISCLOSURE OF INVENTION

Specifically, the present invention relates to:

(1) a high-density detergent composition (hereinafter referred to as "Detergent Composition I") comprising 10 to 60% by weight of a surfactant composition having a weight ratio of an anionic surfactant to a nonionic surfactant of 4:10 or more and 10:0 or less, wherein the high-density detergent composition has a bulk density of from 600 to 1200 g/L, and has a total summation of a product of a mass base frequency Wi and a dissolving rate Vi of each group of classified granules obtained by classifying detergent granules by using a classifier, which satisfies the following formula (A):

$$\Sigma(Wi \cdot Vi) \geqq 95(\%) \quad (A)$$

and wherein a mass base frequency of the classified granules having a size of less than 125 μm is 0.1 or less, wherein the classifier comprises sieves each having a sieve-opening 2000 μm, 1410 μm, 1000 μm, 710 μm, 500 μm, 355 μm, 250 μm, 180 μm, and 125 μm, and a receiver (hereinafter referred to as "classifier"), and the dissolving rate Vi is determined under the following measurement conditions (hereinafter referred to as "measurement conditions for dissolution"):

supplying 1.000 g±0.010 g of a sample to 1.00 L±0.03 L of water at 5° C.±0.5° C. having a water hardness of 4° DH, stirring in a 1 L beaker of which inner diameter is 105 mm, with a cylindrical stirring rod of which length is 35 mm and diameter is 8 mm, at a rotational speed of 800 rpm for 120 seconds, and thereafter filtering insoluble remnants by a standard sieve having a sieve-opening of 300 μm as defined according to JIS Z 8801, wherein the dissolving rate Vi of the classified-granules is calculated by the following formula (a), i being each group of the classified granules:

$$Vi=(1-Ti/Si)\times 100(\%) \quad (a)$$

wherein Si is a weight (g) of each group of the classified granules supplied; and Ti is a dry weight (g) of the insoluble remnants of each group of the classified granules remaining on the sieve after filtration; and (2) a high-density detergent composition comprising 10 to 60% by weight of a surfactant composition having a weight ratio of an anionic surfactant to a nonionic surfactant of 0:10 or more and less than 4:10, the detergent composition having a bulk density of from 600 to 1200 g/L, wherein the high-density detergent composition (hereinafter referred to as "Detergent Composition II") has a total summation of a product of a mass base frequency Wi of each group of classified granules obtained by classifying detergent granules by using the classifier as defined above and a dissolving rate Vi of each group of the classified granules determined under the measurement conditions as defined above, which satisfies the following formula (B):

$$\Sigma(Wi \cdot Vi) \geqq 97(\%) \quad (B)$$

and processes for preparing the same.

Here, the term "mass base frequency" refers to a value obtained by dividing the weight of the classified granules on each sieve or on the receiver by an entire weight of the detergent composition, the classified granules being obtained by classifying the detergent granules with a classifier.

BEST MODE FOR CARRYING OUT THE INVENTION

[1] Composition

Figure 1:
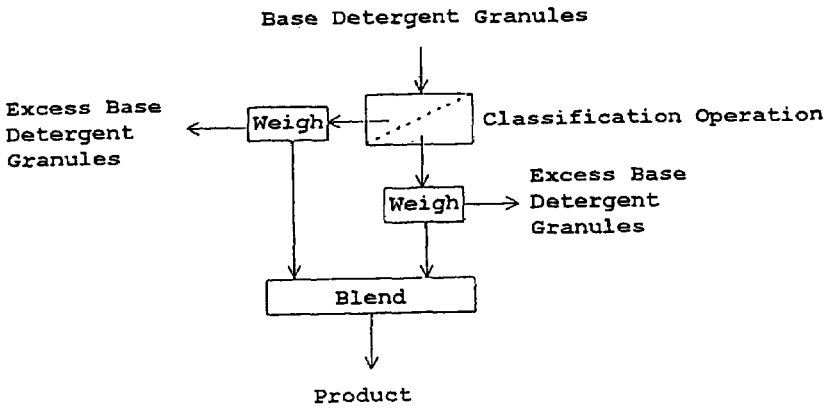
FIG. 1 (1) and (2) each shows a scheme of classification operation in the process of the present invention.
Figure 1:
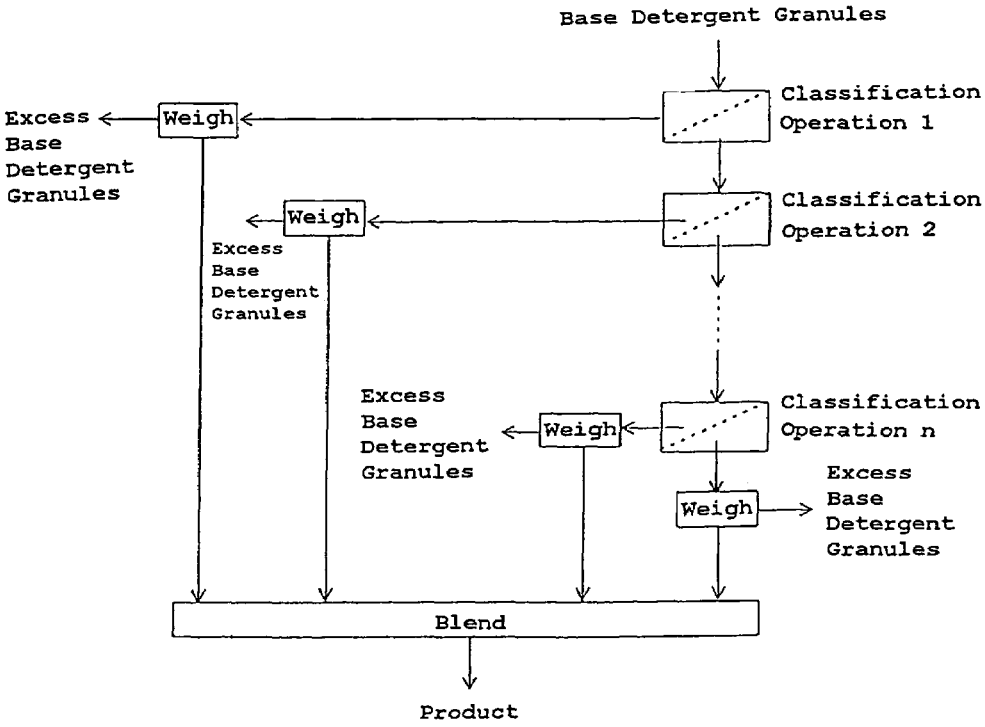

The surfactant composition in the detergent composition of the present invention has a content of from 10 to 60% by weight, preferably from 20 to 50% by weight, more preferably from 27 to 45% by weight, of the detergent composition, from the viewpoints of obtaining the detergency and the desired powder properties of the detergent composition. The surfactant composition comprises an anionic surfactant and/or a nonionic surfactant, and may also comprise a cationic surfactant and an amphoteric surfactant as occasion demands.

The anionic surfactants include alkylbenzenesulfonates, alkyl or alkenyl ether sulfates, alkyl or alkenyl sulfates, α-olefinsulfonates, α-sulfofatty acid salts or esters thereof, alkyl or alkenyl ether carboxylates, salts of fatty acids, and the like. The anionic surfactant has a content of preferably 1 to 50% by weight, more preferably from 5 to 30% by weight of the detergent composition, from the viewpoint of the detergency.

As the counter ions for the anionic surfactants, the alkali metal ions are preferable from the viewpoint of improvement in the detergency. Especially, potassium ions are preferable, from the viewpoint of the improvement in the dissolution rate. The potassium ions are contained in an amount of preferably 5% by weight or more, more preferably 20% by weight or more, particularly preferably 40% by weight or more in the entire counter ions.

The anionic surfactant in the form of potassium salt is prepared by a process for neutralizing an acid precursor of the corresponding anionic surfactant with an alkalizing agent such as potassium hydroxide or potassium carbonate; a process of carrying out cationic exchange by allowing to coexist in the detergent granules a salt of the anionic surfactant other than the potassium salt and potassium carbonate.

The nonionic surfactants include polyoxyalkylene alkyl ethers, polyoxyalkylene alkylphenyl ethers, polyoxyalkylene fatty acid esters, polyoxyethylene-polyoxypropylene alkyl ethers, polyoxyalkylene alkylamines, glycerol fatty acid esters, higher fatty acid alkanolamides, alkylglycosides, alkylglucosamides, alkylamine oxides, and the like. From the viewpoint of detergency, polyoxyalkylene alkyl ethers are preferable, which are ethylene oxide adducts, or a mixture adduct of ethylene oxide and propylene oxide, each of which alcohol moiety has 10 to 18 carbon atoms, preferably 12 to 14 carbon atoms, the average moles of each alkylene oxide being 5 to 30, preferably 6 to 15.

In addition, the polyoxyethylene-polyoxypropylene-polyoxyethylene alkyl ether is preferable, from the viewpoints of the detergency and the dissolubility. The compound can be obtained by reacting an ethylene oxide adduct of which alcohol moiety has 10 to 18 carbon atoms, preferably 12 to 14 carbon atoms with propylene oxide and subsequently with ethylene oxide. Further, among the polyoxyethylene alkyl ethers mentioned above, those having a narrow alkylene oxide distribution are preferable. The compound can be obtained by using a magnesium catalyst described in Japanese Patent Laid-Open No. Hei 7-227540 and the like.

The nonionic surfactant has a content of preferably from 1 to 50% by weight, more preferably from 5 to 30% by weight, of the detergent composition, from the viewpoint of the detergency.

The cationic surfactants include alkyl trimethylammonium salts, and the amphoteric surfactants include carbobetain-type and sulfobetain-type surfactants.

In the detergent composition of the present invention, there can be formulated with water-soluble inorganic salts such as carbonates, hydrogencarbonates, silicates, sulfates, sulfites, and salts of phosphoric acids, from the viewpoint of increasing ionic strength in the washing liquid. Here, the carbonate is contained, calculated on the basis of an anhydride, in an amount of preferably 25% by weight or less, more preferably from 5 to 20% by weight, particularly preferably from 7 to 15% by weight, of the detergent composition, and a total sum of the carbonate and the sulfate, calculated on the basis of an anhydride, in an amount of preferably from 5 to 35% by weight, more preferably from 10 to 30% by weight, particularly preferably from 12 to 25% by weight, of the detergent composition, from the viewpoints of the detergency and the low-temperature dispersibility under the conditions of allowing the detergent composition to stand in cold water for a long period of time.

In the detergent composition of the present invention, crystalline silicates can be formulated. The $SiO_2/M_2O$ molar ratio (wherein M is an alkali metal atom) is preferably 0.5 or more, from the viewpoints of the metal ion capturing ability and the anti-hygroscopic property, and the molar ratio is preferably 2.6 or less, from the viewpoint of the alkalizing ability. The molar ratio is particularly preferably from 1.5 to 2.2. It is preferable to formulate a crystalline silicate having an average particle size of from about 1 to about 40 μm, from the viewpoints of the fast dissolubility and the powder properties, and its content is preferably from 0.5 to 40% by weight, more preferably from 1 to 25% by weight, of the detergent composition, from the viewpoints of the powder properties and the detergency after storage. Especially, its combined use with sodium carbonate is preferable.

In addition, in the detergent composition of the present invention, there can be formulated organic acid salts such as citrates, hydroxyiminodisuccinates, methylglycine diacetates, glutamate diacetates, aspartate diacetates, serine diacetates, ethylenediaminedisuccinates, and ethylenediaminetetracetates, from the viewpoint of the metal ion capturing ability. Also, it is preferable to formulate a cationic exchange-type polymer having carboxylic acid group and/or sulfonic acid group, from the viewpoint of the metal ion capturing capacity and the dispersibility of the solid particle stains. Especially, desirable are salts of acrylic acid-maleic acid copolymers having a molecular weight of 1000 to 80000; polyacrylates; and salts of polyacetal carboxylic acids such as polyglyoxylic acid having a molecular weight of 800 to 1000000, preferably from 5000 to 200000 described in Japanese Patent Laid-Open No. Sho 54-52196.

The cationic exchange-type polymer and/or organic acid salt is contained in an amount of preferably from 0.5 to 12% by weight, more preferably from 1 to 10% by weight, still more preferably from 1 to 7% by weight, particularly preferably from 2 to 5% by weight, of the detergent composition, from the viewpoint of the detergency.

In addition, the crystalline aluminosilicate such as A-type, X-type, or P-type zeolite can be formulated, and the average primary particle size is preferably from 0.1 to 10 μm. Also, an amorphous aluminosilicate having an oil-absorbing capacity of 80 mL/100 g or more as determined by the method in accordance with JIS K 5101 can be formulated, for the purpose of preventing bleeding out of the liquid components such as the nonionic surfactant. As the amorphous aluminosilicates, for instance, there may be referred to Japanese Patent Laid-Open Nos. Sho 62-191417, Sho 62-191419, and the like. The amorphous aluminosilicate has a content of preferably from 0.1 to 20% by weight of the detergent composition.

The detergent composition of the present invention can be formulated with organic acid salts such as citrates and ethylenediaminetetraacetate; dispersing agents or dye-transfer inhibitors such as carboxymethyl cellulose, polyethylene glycols, polyvinyl pyrrolidones and polyvinyl alcohols; bleaching agents such as percarbonates; bleaching activators such as compounds listed in Japanese Patent Laid-Open No. Hei 6-316700 and tetraacetylethylenediamine; enzymes such as protease, cellulase, amylase, and lipase; biphenyl-type or stilbene-type fluorescent dyes; defoaming agents; antioxidants; blueing agents; perfumes, and the like. Incidentally, granules prepared by separately granulating an enzyme, a bleaching activator, a defoaming agent, and the like may be after-blended.

In addition, as a preferred one embodiment, in the detergent composition of the present invention, there can be formulated with sodium carbonate and an alkali metal silicate, wherein sodium carbonate is contained in an amount of from 1 to 15% by weight, and a total sum of sodium carbonate and the alkali metal silicate (wherein $SiO_2/M_2O$ is from 0.5 to 2.6, wherein M is an alkali metal atom) is from 16 to 40% by weight.

It is very important that the sebum stain is washed by laundry detergent, and it is preferable to formulate an alkalizing agent in a high content, for which inexpensive sodium carbonate is widely usable. Especially, when sodium carbonate is contained in the amount specified above, the dispersibility can be even more well maintained without forming crystals of hydrates between the detergent granules under the condition of allowing to stand the detergent composition in cold water for a long period of time. Therefore, it is desired that sodium carbonate is contained in an amount, calculated on the basis of an anhydride, of 15% by weight or less, preferably from 1 to 15% by weight, more preferably from 5 to 15% by weight, still more preferably from 7 to 15% by weight, particularly preferably from 7 to 13% by weight, most preferably from 7 to 11% by weight, of the detergent composition.

In addition, sodium carbonate is used in combination with an alkali metal silicate capable of maintaining excellent low-temperature dispersibility without forming hydrated crystals between the detergent granules, in order to obtain excellent detergency. A total sum of the sodium carbonate and the alkali metal silicate is preferably 16% by weight or more, more preferably 19% by weight or more, particularly preferably 22% by weight or more, and the total sum is more preferably from 40% or less, more preferably 35% by weight or less, particularly preferably 30% by weight or less, from the viewpoint of the compositional proportion with other ingredients formulated.

Here, as the alkali metal silicates, there can be used those of either crystalline or amorphous forms, and those in a crystalline form are preferable, from the viewpoint of also having the cationic exchange capacity.

In the alkali metal silicate, $SiO_2/M_2O$ (wherein M is an alkali metal) is preferably 2.6 or less, more preferably 2.4 or less, particularly preferably 2.2 or less, from the viewpoint of the alkalizing ability, and it is preferably 0.5 or more, more preferably 1.0 or more, still more preferably 1.5 or more, particularly preferably 1.7 or more, from the viewpoint of the storage stability.

Here, as the amorphous alkali metal silicates, there may be used, for instance, JIS NO. 1, No. 2 sodium silicates; dried granular products of water glass such as Britesil C20, Britesil $H_2O$, Britesil C24, and Britesil H24 (each being registered trademarks trade mark, manufactured by "The PQ Corporation"). Also, there may be used "NABION 15" (registered trademark, manufactured by RHONE-POULENC), which is a composite of sodium carbonate and amorphous alkali metal silicate.

The alkali metal silicate has excellent alkalizing ability and cationic exchange capacity comparable to that of 4A-type zeolite by allowing it to crystallize. In addition, the alkali metal silicate is a very preferable agent from the viewpoint of the low-temperature dispersibility. Therefore, one or more crystalline alkali metal silicates which are represented by the following formula (I):

$$x(M_2O).y(SiO_2)z(Me_mO_n).w(H_2O) \quad (I)$$

wherein M stands for an element in Group Ia of the Periodic Table, preferably K and/or Na; Me stands for one or more elements selected from Group Ia elements, Group IIb elements, Group IIIa elements, Group IVa elements, and Group VIII elements of the Periodic Table, preferably Mg and Ca; y/x is from 0.5 to 2.6; z/x is from 0.001 to 1.0; w is from 0 to 20; n/m is from 0.5 to 2.0, and/or represented by the formula (II):

$$M_2O.x'(SiO_2).y'(H_2O) \quad (II)$$

wherein M stands for an alkali metal element, preferably K and/or Na; x' is from 1.5 to 2.6; and y' is from 0 to 20, preferably substantially 0, are contained in an amount of preferably from 0.5 to 40% by weight, more preferably from 1 to 25% by weight, more preferably from 3 to 20% by weight, particularly preferably from 5 to 15% by weight, of the detergent composition. Here, it is preferable that those in a crystalline form is contained in an amount of 20% by weight or more, more preferably 30% by weight or more, particularly preferably 40% by weight or more, of the alkali metal silicate.

The crystalline alkali metal silicate can be made available, for instance, under the trade name of "Na-SKS-6" ($\delta$-$Na_2O.2SiO_2$) from Clariant Japan Co., and those in powdery form and/or granular form may be used.

Processes for addition of these agents in the preparation process are as follows. As for adding sodium carbonate, there may be employed a process comprising adding sodium carbonate to an aqueous slurry, and spray-drying the mixture, thereby powdering the product; a process comprising adding sodium carbonate adjusted to an average particle size of from about 1 to about 40 μm in a granulation step or a surface-modifying step; or a process of after-blending dense ash or light ash. As for adding an amorphous alkali metal silicate, there may be employed a process comprising adding an amorphous alkali metal silicate in an aqueous slurry, and spray-drying the mixture; a process of after-blending the amorphous alkali metal silicate previously granulated, and the like. As for adding a crystalline alkali metal silicate, there may be employed a process comprising adding a crystalline alkali metal silicate adjusted to an average particle size of from about 1 to about 40 μm, preferably from about 1 to about 30 μm, more preferably from about 1 to about 20 μm, still more preferably from about 1 to about 10 μm in a granulation step or a surface-modifying step. During the addition, it is preferable to use in admixture with an agent such as a crystalline and/or amorphous aluminosilicate, from the viewpoint of the storage stability, and the like. In addition, there may be employed a process of after-blending the granules prepared by a process employing a roller compactor disclosed in Japanese Patent Laid-Open No. Hei 3-16442.

In addition, as another preferred embodiment, in the detergent composition of the present invention, an anionic surfactant having sulfuric acid group and/or sulfonate can be formulated in an amount of 5% by weight or more to the detergent composition. By the use of the anionic surfactant, the dispersibility among the detergent granules can be even more excellently maintained under the conditions of allowing the detergent to stand in cold water for a long period of time. The content of the anionic surfactant is preferably 5% by weight or more, more preferably 7% by weight or more, particularly preferably 10% by weight or more. Preferable are alkylbenzenesulfonates, α-olefinsulfonates, α-sulfofatty acid salts or esters thereof, and particularly preferable are alkylbenzenesulfonates.

[2] Bulk Density

The bulk density of the detergent composition determined in accordance with JIS K3362 is from 600 to 1200 g/L. From the viewpoints of improvement in the transportation efficiency and the convenience of the users, the bulk density is 600 g/L or more, preferably 650 g/L or more, more preferably 700 g/L or more. From the viewpoint of keeping the void between the granules and improving the dispersibility owing to the suppression of the increase in number of contact between the granules, the bulk density is 1200 g/L or less.

[3] Particle Size Distribution

The detergent composition of the present invention is excellent in the dissolubility per one granule of the detergent granules and the dispersibility (prevention of forming aggregation of the detergent granules). Here, the dispersibility refers to a phenomenon where after initiation of dissolving a part of a surfactant capable of forming liquid crystals and an inorganic salt forming hydrated crystals of carbonates, sulfates and the like, the remainder part forms highly viscous liquid crystals between the detergent granules or recrystallizes into a hydrate more quickly than being dissolved. Therefore, from the viewpoint of the dispersibility, the particle size distribution of the detergent composition of the present invention is such that the mass base frequency of the classified granules having a size of less than 125 μm in the detergent composition I or II is 0.1 or less or 0.08 or less, respectively.

From the viewpoints of improvements in the dispersibility and the flowability, it is preferable that the content of the fine powder in the detergent composition is small. The mass base frequency of the classified granules having a particle size of less than 125 μm is such that in the detergent composition I, the mass base frequency of the classified granules having a size of less than 125 μm is 0.1 or less, preferably 0.08 or less, more preferably 0.06 or less, particularly preferably 0.05 or less, and that in the detergent composition II, the mass base frequency of the classified granules having a size of less than 125 μm is 0.08 or less, preferably 0.06 or less, more preferably 0.04 or less. In addition, the mass base frequency of the classified granules having a particle size of 125 μm or more and less than 180 μm in both the detergent compositions I and II is preferably 0.2 or less, more preferably 0.1 or less, particularly preferably 0.05 or less. Here, regarding the fine powder, it is preferable that each mass base frequency satisfies the relationship such that the mass base frequency of [classified granules having a particle size of less than 125 μm]≦[classified granules having a particle size of 125 μm or more and less than 180 μm].

In addition, from the viewpoint of fast dissolubility per one granule, it is preferable that the content of the coarse granules in both the detergent compositions I and II is small. Specifically, the mass base frequency of the classified granules having a particle size of 1000 μm or more is preferably 0.03 or less, more preferably 0.01 or less, particularly preferably substantially none. The mass base frequency of the classified granules having a particle size of 710 μm or more and less than 1000 μm is preferably 0.1 or less, more preferably 0.05 or less, particularly preferably 0.03 or less. The mass base frequency of the classified granules having a particle size of 500 μm or more and less than 710 μm is 0.1 or less, preferably 0.05 or less, more preferably 0.03 or less. Here, regarding the coarse granules, it is preferable that each mass base frequency satisfies the relationship such that the mass base frequency of [classified granules having a particle size of 1000 μm or more]≦[classified granules having a particle size of 710 μm or more and less than 1000 μm]≦[classified granules having a particle size of 500 μm or more and less than 710 μm].

The detergent composition of the present invention has an average particle size of preferably from 150 μm to 500 μm, more preferably from 200 μm to 400 μm, particularly preferably from 250 μm to 350 μm. Here, the average particle size (Dp) is a 50% mass base diameter, and can be determined by using the classifier mentioned above. Specifically, after classification operation, the mass base frequency is accumulated sequentially from finer powders to coarser granules. When a sieve-opening of a first sieve of which cumulative mass base frequency is 50% or more is defined as a μm, and a sieve-opening of one sieve-opening larger than a μm is defined as b μm, in a case where the cumulative mass base frequency from the receiver to the a μm-sieve is defined as c %, and the mass base frequency of granules on the a μm-sieve is defined as d %, the average particle size can be calculated according to the equation (b).

$$Dp=10^{A} \quad (b)$$

wherein $A=[50-(c-d/(\log b-\log a)\times\log b)]/[d/(\log b-\log a)]$

[4] Dissolubility of Classified Granules

In the determination of the dissolubility of each group of the classified granules, first a sample accurately weighed by using, for example, an electronic balance "Model ER-180A" manufactured by Kensei Kogyo K.K. is supplied evenly so as not to cause aggregation of the granules and stirred, and thereafter filtered with a standard sieve defined by JIS Z 8801 (sieve-opening: 300 μm) [the sieve having a sieve area of 35 $cm^2$ or more and a weight within 10 g is used, and the weight is previously measured]. Subsequently, the insoluble remnants of each group of the classified granules remained on the sieve are subjected to drying operation together with the sieve for 1 hour in an electric dryer at 105° C., and allowed to cool for 30 minutes in a desiccator (25° C.) containing an activated silica gel therein. Thereafter, the weight is determined. By subtracting the weight of the sieve from this determined weight, the dry weight of the insoluble remnants of each group of the classified granules can be calculated.

The concrete determination conditions are as described as the conditions for dissolubility determination described above. Here, the sieve-opening of 300 μm is roughly corresponding to a pore size of a lint filter attached to the washing machine, which means that the high-density detergent composition of the present invention can pass through the lint filter in a very short period of time even with a water temperature of 5° C. This means that this detergent composition can satisfactorily meet the requirements for short time washing modes of the recent washing machines.

[5] Dissolubility of Detergent Composition

The dissolubility of the detergent composition of the present invention is expressed by a total summation of a product of a mass base frequency Wi of each group of the classified granules and a dissolving rate Vi of each group of the classified granules [namely $\Sigma(Wi\cdot Vi)$]. The dissolubility of the detergent composition I is 95% or more, preferably 96% or more, more preferably 97% or more, still more preferably 98% or more, particularly preferably 99% or more, and the dissolubility of the detergent composition II is 97% or more, preferably 98% or more, more preferably 99% or more.

Since the detergent composition of the present invention has extremely high dissolubility markedly distinctive from those of conventional detergent compositions, the probability of causing insoluble remnants even washing under the conditions of super-low mechanical power is extremely low, aside from having such effects that the detergency is increased by eluting the deterging components more quickly in the washtub.

[6] Hand-Washing Dissolubility of Detergent Composition

The detergent composition of the present invention also exhibits remarkably excellent hand-washing dissolubility as compared to conventional detergent compositions. The hand-washing dissolubility refers to a measure of the dissolubility when a detergent composition is previously dissolved in a vessel such as a washbowl in a case where stained garments are hand-washed, and expressed by dissolution period of time. Hand-washing is customarily widely employed washing not only as a matter of course for users whose main washing method is hand-washing but also as pre-washing of stained clothes for users whose main washing method is machine washing. Therefore, the hand-washing dissolubility is important as a measure for reflecting a more excellent easy-to-use property.

A concrete method for measurement is as follows. In a washbowl (Model "KW-30" washtub manufactured by YAZAKI, inner volume: 8.2 L) made of polypropylene having a largest opening diameter of 31 cm, a bottom diameter of 24 cm and a height of 13 cm was placed 5.0 L of tap water at 25° C. Next, 15 g of a detergent composition to be tested is dispersed on entire water surface uniformly and quickly (within 3 seconds or so as a standard) so as not to aggregate in one site. From this point of time, a panelist initiates stirring with one hand (the dominant hand), with widely stretched five fingers sensing the detergent granules existing at the bottom of the washbowl with finger tips (inner side of the fingers), in such a manner of gently touching the bottom of washbowl with finger tips. Here, stirring is carried out by repeating each clockwise rotations and counterclockwise rotations alternating with a period of 5 rotations. The stirring is carried out so as not to spill the sample solution from the side wall of the washbowl (the stirring is carried out in about 1.0 second per one rotation, and when reversely rotated, a stand-still is held for about 1.0 second as a standard.). In the manner described above, the stirring is continued until the detergent granules are no longer sensed, and the period of time is measured. A panelist repeats a test for a test sample until the deviation of the determined period of time for three runs is within ±5%, and the average period of time of the three runs is referred to as the period of time for the hand-washing dissolubility of the panelist.

The evaluation is carried out by panelists of 10 or more, and an average value of the period of time for the hand-washing dissolubility for the middle 60% of the panelists, excluding the top 20% and the bottom 20% of the panelists, is referred to as the period of time of the hand-washing dissolubility of the tested detergent composition.

The hand-washing dissolubility of the detergent composition I of the present invention is preferably 100 seconds or less, more preferably 80 seconds or less, still more preferably 60 seconds or less, still more preferably 50 seconds or less, still more preferably 40 seconds or less, particularly preferably 30 seconds or less. The hand-washing dissolubility of the detergent composition II of the present invention, which is the same as the detergent composition I, is preferably 100 seconds or less, more preferably 80 seconds or less, still more preferably 60 seconds or less, still more preferably 50 seconds or less, still more preferably 40 seconds or less, particularly preferably 30 seconds or less.

[7] Flowability

When the detergent composition of the present invention is placed in a washing machine, it is preferable that its flowability is excellent (more likely to be evenly dispersed) in order to alleviate the lowering of the dispersibility when the composition is in contact with water in a case where the composition is locally gathered together. The flow time (a time period required for dropping 100 mL of powder from a hopper used in a measurement of bulk density according to JIS K 3362) is preferably 10 seconds or shorter, more preferably 8 seconds or shorter, still more preferably 6.5 seconds or shorter.

[8] Preparation Process

The detergent composition of the present invention can be prepared by subjecting unclassified detergent granules, comprising 10 to 60% by weight of a surfactant composition, to classification operation and particle size adjustment operation (the detergent granules being hereinafter also referred to as "base detergent granules"; here, classified granules obtained by subjecting base detergent granules to a plural times of classification operation and operation for particle size adjustment may be also included in the base detergent granules).

(Step 1-1) Preparation Step of Base Detergent Granules of Detergent Composition I As one embodiment of the process for preparing base detergent granules usable in the detergent composition I, there can be employed a process comprising preparing spray-dried particles comprising a surfactant and a builder, and increasing bulk density. Such a process includes, for instance, a process comprising stirring and granulating spray-dried particles in a vertical or horizontal mixer, thereby increasing the bulk density. As examples of such processes, there can be employed a process disclosed in Japanese Patent Laid-Open No. Sho 61-69897, comprising stirring and granulating spray-dried particles; a process disclosed in Japanese Patent Laid-Open No. Sho 62-169900, comprising forming dried particles, and thereafter disintegrating and granulating the dried particles; a process disclosed in Japanese Patent Laid-Open No. Sho 62-236897, comprising disintegrating a solid detergent obtained by kneading and mixing detergent raw materials; from the viewpoint of energy saving, as a process without using a spray-drying tower, a process disclosed in Japanese Patent Laid-Open No. Hei 3-33199, comprising neutralizing in a dry state an acid precursor of an anionic surfactant with a granular, solid alkalizing agent in a high-speed mixer, and thereafter adding a liquid binder to form granules, and the like.

(Step 1-2) Preparation Step of Base Detergent Granules of Detergent Composition II As one embodiment of the process for preparing base detergent granules usable in the detergent composition I, there can be employed a process disclosed in Japanese Patent Laid-Open No. Hei 10-176200, comprising granulating a mixture comprising a nonionic surfactant, an acid precursor of an anionic surfactant capable of having a lamellar orientation, and an alkalizing agent, while tumbling with a granulator at a temperature not less than the temperature capable of neutralizing the mixture, and the like.

(Step 2) Particle Size Adjustment Step

The base detergent granules are subjected to particle size adjustment, whereby the detergent composition of the present invention can be obtained.

The detergent composition I can be obtained by subjecting base detergent granules to at least one step of classification operation; thereafter determining a mass base frequency for each group of sieve-on classified granules and sieve-pass classified granules against an amount of the base detergent granules supplied; and blending each group of classified granules such that the formula (A) as defined above is satisfied, and that a mass base frequency of the classified granules having a size of less than 125 μm is 0.1 or less. Similarly, the detergent composition II can be obtained by blending each group of classified granules such that the formula (B) as defined above is satisfied, and that a mass base frequency of the classified granules having a size of less than 125 μm is 0.08 or less.

In addition, the classification operation may be single-step operation as shown in FIG. 1 (1), or two or more steps of operations as shown in FIG. 1 (2) as occasion demands. A desired detergent composition can be obtained, for instance, by separating coarse granules in the first-step classification operation, from the viewpoint of the fast dissolubility per one granule; separating fine powder, for instance, classified granules having a size of less than 125 μm, in the second-step classification operation, from the viewpoint of the low-temperature dispersibility; and subjecting part or entire fine powder to granulation operation to be supplied again as the base detergent granules. The classification method includes a method employing a circular or sectoral vibration sieve; an ultrasonic vibration sieve comprising the vibration sieve and an ultrasonic oscillator attached thereto; an air classifier or centrifugal classifier, and the like. In addition, as the blending method, there can be employed a blending method in a batch process with a V-type mixer, or the like, or continuous process.

Incidentally, the determination of the mass base frequency after each of classification operation in the classification and particle size adjustment steps in (Step 2) is not essential, and the determination can be omitted as occasion demands. For instance, in the actual preparation step of the single-step classification operation shown in FIG. 1 (1), in a case of the sieve-on classified granules which are obtained after separating and removing fine powder, for instance, classified granules having a size of less than 125 μm, where the formula (A) as defined above is satisfied and a mass base frequency of granules having a size of less than 125 μm is 0.1 or less for the detergent composition I; or in a case of the sieve-on classified granules as described above where the formula (B) as defined above is satisfied and a mass base frequency of granules having a size of less than 125 μm is 0.08 or less for the detergent composition II, the determination of the mass base frequency after the classification operation is omitted, and the sieve-on classified granules can be used directly as a product. Similarly, in a case of the sieve-pass classified granules which are obtained after separating and removing coarse granules, for instance, classified granules having a size of 500 μm or more, where the formula (A) as defined above is satisfied and a mass base frequency of granules having a size of less than 125 μm is 0.1 or less for the detergent composition I; or in a case of the sieve-pass classified granules where the formula (B) as defined above is satisfied and a mass base frequency of granules having a size of less than 125 μm is 0.08 or less for the detergent composition II, the determination of the mass base frequency after the classification operation is omitted, and the sieve-pass classified granules can be used directly as a product. In addition, these operations can be combined in multiple steps.

In addition, the detergent composition can be obtained in a high yield by granulating and/or disintegrating the base detergent granules which are excess base detergent granules not subjected to particle size adjustment; and thereafter reusing as the base detergent granules. In other words, those granules, like fine powder having a size of less than 125 μm having excellent dissolubility per one granule but having a concern for decreasing the dispersibility of the detergent composition by an increase in the number of contact between the granules can be reused as base detergent granules after subjecting to a treatment for increasing particle size such as granulation operation. It is especially important for the detergent composition of the present invention that the mass base frequency of the classified granules having a size of less than 125 μm is reduced, and the process becomes economically advantageous by carrying out the above operations. On the other hand, excess coarse granules which are poor in the dissolubility per one granule can be reused as base detergent granules after subjecting the coarse granules to a treatment for decreasing particle size such as disintegration operation.

Specifically, in the detergent composition I, the classified granules not used in Steps 1-1 or 1-2 and 2 mentioned above can be preferably reused as base detergent granules in reference to the dissolving rate Vi, in a case where, for instance, fine powder having Vi of 95% or more is subjected to granulation operation, or coarse granules having Vi of less than 95% are subjected to disintegration operation. Similarly, in the detergent composition II, fine powder having Vi of 97% or more is subjected to granulation operation, or coarse granules having Vi of less than 97% are subjected to disintegration operation, whereby the granules are preferably reused as base detergent granules. The fine powder granulation operation and the coarse granules disintegration operation are exemplified below.

(Fine Powder Granulation Operation)

Excess fine powder may be collected by adding them in the form of fine powder without treatment during the preparation process of Step 1-1 or 1-2 for the base detergent granules. In addition, as an alternative collecting method, for instance, the excess fine powder may be collected by a process comprising compressing and granulating in a vertical or horizontal granulator; an extruding granulation process employing an extruder; a compression-granulation method such as briquetting, and the like. In addition, a binder can be added during granulation.

(Coarse Granules Disintegration Step)

Excess coarse granules can be reused as base detergent granules by, for instance, disintegrating the coarse granules, thereby decreasing their particle size. The disintegrator for coarse granules includes impact crushers such as hammer crusher; impact pulverizers such as atomizers and pin mills; shearing rough pulverizers such as flash mills. These disintegrators may comprise single-step operation, or multi-step operations with the same or different disintegrators. Incidentally, it is preferable to add fine powder as an agent for controlling deposition within devices or as a surface-modifying agent for pulverized surfaces. The fine powder is preferably inorganic powders such as aluminosilicates, silicon dioxide, bentonite, talc and clay amorphous silica derivatives, and especially, crystalline or amorphous aluminosilicates are preferable. In addition, fine powders of inorganic salts such as sodium carbonate and sodium sulfate can be used.

In addition, for the purpose of coating and smoothening a surface-modifying agent for improving flowability of the disintegrated granules, a surface-modifying step can be provided in the process. For instance, there may be employed the process comprising supplying a composition in a batch process or continuous process into a rotatable cylindrical mixer or an agitator, thereby subjecting the composition to tumbling or stirring treatment.

By the combination of the fine powder granulation operation and the coarse granules disintegration operation, the detergent composition can be obtained in a high yield from the excess classified detergent granules in Step 2. In addition, after the classification and particle size adjustment steps, there can be formulated enzymes, dyes, perfumes, and the like.

Evaluation 1 [Dissolubility of Detergent] A lint filter (model number: AXW22A-5RU0, pore-size: 300×640 μm) was attached to a side wall portion of a washtub of a washing machine "AISAIGO NA-F70VP1" manufactured by Matsushita Electric Industrial Co., Ltd. Next, 3 kg of clothes (cotton underwear: 50% by weight, dress shirt made of mixed fabric of polyester/cotton: 50% by weight) were placed thereinto, and thereafter 44.0 g of each detergent composition of Examples was uniformly dispersed. Tap water at 5° C. was poured thereinto, and washing was carried out by a setting of "standard course: 3 minutes washing and high water level (66 L)." After termination (without including rinsing step), the amount of the detergent remained in the lint filter was visually determined by the following evaluation criteria. The water temperature at 5° C. was a disadvantageous condition for the dissolubility of the granules, so that the evaluation results A, B and C indicated excellent dissolubility of the granules.

[Evaluation Criteria]

A: The remnants of the detergent granule being almost zero (estimate number of remained detergent granules: 0 to 5 granules);

B: No remnant detergent granules (estimate number of remained detergent granules: 6 to 15 granules);

C: Substantially no remnant detergent granules (estimate number of remained detergent granules: 16 to 30 granules);

D: The remnants of detergent granules being in small amounts (estimate number of remained detergent granules: 30 to 100 granules);

E: The remnants of detergent granules being in large amounts (estimate number of remained detergent granules: 101 or more, the remnants of paste being also scattered).

Evaluation 2 [Dispersibility of Detergent] The amount 25.0 g of each detergent composition of Examples was placed in an aggregated state near the outer periphery of one of the dents of a sector, a six-divided section of a pulsator of washing machine "AISAIGO NA-F42Y1" manufactured by Matsushita Electric Industrial Co., Ltd. The amount 1.5 kg of the clothes (the same as in Evaluation 1) was placed in the washtub, without disintegrating the agglomeration. Twenty-two liters of tap water at 5° C. was poured thereto at a flow rate of 10 L/min such that the water would not directly hit the detergent. After the termination of water-pouring, the aqueous mixture was allowed to stand. After 3 minutes from the start of water-pouring, the stir was started with gentle water flow (handwashing-mode). After stirring for 3 minutes, water was discharged, and the states of detergents remained on the clothes and the washtub were visually determined by the following evaluation criteria. The stir strength of this evaluation was very weak as compared to that of the standard mode, so that the evaluation criteria I and II indicated excellent dispersibility. In addition, the term "aggregates" described below refers to a mass of aggregated detergent granules having a diameter of 3 mm or more.

[Evaluation Criteria]

I: No aggregates;

11: Substantially no aggregates (1 to 5 masses having a diameter of about 3 mm being found);

III: Aggregates remaining in small amounts (masses having a diameter of about 6 mm being found, and 10 or less masses having a diameter of from 3 to 10 mm being found); and IV: Aggregates remaining in large amounts (a large number of masses having a diameter exceeding 6 mm being found).

Evaluation 3 [Detergency of Detergent] An artificial soil solution having the following compositions was smeared to a cloth to prepare an artificially stained cloth. The smearing of the artificial soil solution to a cloth was carried out in accordance with Japanese Patent Laid-Open No. Hei 7-270395 wherein the artificial soil solution was printed on a cloth by a gravure staining machine equipped with a gravure roll coater. The process for smearing the artificial soil solution to a cloth to prepare an artificially stained cloth was carried out under the conditions of a cell capacity of a gravure roll of 58 $cm^3/cm^2$, a coating speed of 1.0 m/min, a drying temperature of 100° C., and a drying time of one minute. As to the cloths, #2003 calico (manufactured by Tanigashira Shoten) was used.

(Composition of Artificial Soil Solution)

Lauric acid: 0.44% by weight (hereinafter "%"), myristic acid: 3.09%, pentadecanoic acid: 2.31%, palmitic acid: 6.18%, heptadecanoic acid: 0.44%, stearic acid: 1.57%, oleic acid: 7.75%, triolein: 13.06%, n-hexadecyl palmitate: 2.18%, squalene: 6.53%, lecithin, from egg: 1.94%, Kanuma red clay: 8.11%, carbon black: 0.01%, and tap water: balance.

(Detergent Conditions and Evaluation Method)

The amount 2.2 kg of clothes (underwear and dress shirt in a proportion of 8/2) and 10 pieces of the artificially stained cloths of 10 cm×10 cm sewn on to 3 pieces of cotton support cloths of 35 cm×30 cm were evenly placed in a washing machine "AISAIGO NA-F40AP" manufactured by Matsushita Electric Industrial Co., Ltd. Twenty-two grams of each detergent composition was placed on the clothes in an aggregated state, and water was poured thereto such that the water would not directly hit the detergent. The washing was carried out under the standard course. The washing conditions are as follows.

Washing course: standard course; detergent concentration: 0.067%; water hardness: 2.7° DH; water temperature: 5° C.; liquor ratio: 15 L/kg.

The detergency was evaluated by measuring the reflectance at 550 nm of the unstained cloth and those of the stained cloth before and after washing by an automatic recording calorimeter (manufactured by Shimadzu Corporation), and the detergency (%) was calculated by the following equation. The average value determined of 10 pieces was expressed as the detergency.

Detergency(%)=(Reflectance of Cloth After Washing−Reflectance of Stained Cloth Before Washing)/(Reflectance of Unstained Cloth−Reflectance of Stained Cloth Before Washing)×100

Evaluation 4 [Hand-Washing Dissolubility] The hand-washing dissolubility was determined by the measurement method described above. As for the washbowl, the Model KW-30 washtub manufactured by YAZAKI was used, and the hand-washing dissolubility was measured by 10 panelists.

PREPARATION EXAMPLE 1

Parts by Weight being Hereinafter Expressed as "Parts"

Twenty-five parts of a sodium linear alkyl(10 to 13 carbon atoms)benzenesulfonate; 3 parts of a sodium alkyl(12 to 16 carbon atoms)sulfate; 2 parts of a polyoxyethylene (average moles of EO: 8) alkyl(12 to 14 carbon atoms) ether (hereinafter referred to as "nonionic surfactant"); 3 parts of a soap (14 to 20 carbon atoms); 10 parts of zeolite 4A; 9 parts of No. 1 sodium silicate; 10 parts of sodium carbonate; 2 parts of potassium carbonate; 1.5 parts of sodium sulfate; 0.5 parts of sodium sulfite; 1 part of sodium polyacrylate (average molecular weight: 10,000); 3 parts of an acrylic acid-maleic acid copolymer (Sokalan CP5); 1.5 parts of a polyethylene glycol (average molecular weight: 8,500); and fluorescent dyes (0.1 parts of Tinopal CBS-X and 0.1 parts of WHITEX SA) were mixed with water to prepare a slurry having a solid ingredient of 50% by weight (temperature: 65° C.). The resulting slurry was dried by using a countercurrent flow type spray-dryer to give particles having a bulk density of about 300 g/L. The content of volatile matter was 4% (amount lost at 105° C. for 2 hours). Subsequently, 78 parts of the granules and 3 parts of zeolite 4A (average particle size: about 3 μm) were introduced into a High-Speed Mixer (manufactured by Fukae Powtec Corp., volume capacity: 25 L), and mixed. Thereafter, 5 parts of crystalline silicate powders (pulverized product of SKS-6, average particle size: 27 μm) were introduced into the mixer, and the mixture was further pulverized and granulated with stirring, while spraying 4 parts of the above nonionic surfactant thereto. In this process, 5 parts of the above powdery zeolite was added for surface-coating immediately before the termination of the process, to give base detergent granules (1). The entire charged amount was 5 kg.

PREPARATION EXAMPLE 2

Fourteen parts of a potassium linear alkyl(10 to 13 carbon atoms)benzenesulfonate; 8 parts of a sodium salt of methyl ester of α-sulfofatty acid (14 to 16 carbon atoms); 1 part of the same nonionic surfactant as in Preparation Example 1; 7 parts of the same soap as in Preparation Example 1; 10 parts of zeolite 4A; 1 part of No. 1 sodium silicate; 5 parts of sodium carbonate; 16 parts of potassium carbonate; 1.1 parts of sodium sulfate; 1.5 parts of sodium sulfite; 2 parts of the same sodium polyacrylate as in Preparation Example 1; 2 parts of the same polyethylene glycol as in Preparation Example 1; and fluorescent dyes (0.2 parts of Tinopal CBS-X and 0.1 parts of WHITEX SA) were mixed with water to prepare a slurry having a solid ingredient of 48% by weight (temperature: 65° C.). The resulting slurry was dried by using a countercurrent flow type spray-dryer to give particles having a bulk density of about 320 g/L. The content of volatile matter was 3% (amount lost at 105° C. for 2 hours). Subsequently, 50 kg/H of the above particles, 4 kg/H of sodium carbonate (heavy ash), 1 kg/H of the same crystalline silicate powders as in Preparation Example 1, and 3 kg/H of the same nonionic surfactant as in Preparation Example 1 were continuously supplied to a continuous kneader (manufactured by Kurimoto Tekkosho K.K.). The resulting mixture was pelletized by using a twin-screw extruder ("PELLETER DOUBLE," manufactured by Fuji Paudal Co., Ltd.) arranged at the discharge outlet of the kneader to give cylindrical pellets having a diameter of about 3 mm. Five parts of powdery zeolite (average particle size: about 3 μm) was added as an aid agent for pulverizing, based on 100 parts of the pellets, and the mixture was pulverized and granulated by a Fitz Mill (manufactured by Hosokawa Micron Corporation) equipped with a screen having a 1.5 mm-sieve opening with aeration of cool air at 14° C.

PREPARATION EXAMPLE 3

Twenty-four parts of a sodium linear alkyl(10 to 13 carbon atoms)benzenesulfonate; 4 parts of the same sodium alkylsulfate as in Preparation Example 1; 4 parts of the same nonionic surfactant as in Preparation Example 1; 1 part of a soap (14 to 20 carbon atoms); 14 parts of No. 1 sodium silicate; 14 parts of sodium carbonate; 4 parts of sodium sulfate; 4 parts of the same acrylic acid-maleic acid copolymer as in Preparation Example 1; 1 part of the same polyethylene glycol as in Preparation Example 1; and fluorescent dyes (0.1 parts of Tinopal CBS-X and 0.1 parts of WHITEX SA) were mixed with water to prepare a slurry having a solid ingredient of 50% by weight (temperature: 63° C.). The resulting slurry was dried by using a countercurrent flow type spray-dryer to give particles having a bulk density of about 300 g/L. The content of volatile matter was 2.5% (amount lost at 105° C. for 2 hours). Subsequently, 70 parts of the above particles, 7 parts of powdery zeolite (average particle size: about 3 μm), and 5 parts of the same crystalline silicate as in Preparation Example 1 were blended by using a ribbon blender. The mixture was compressed to regulate its sizes at a roll pressure of about 1 MPa by a Chilsonator (manufactured by Fuji Paudal Co., Ltd., roll width: 102 mm, roll diameter: 254 mm), and the resulting granules were classified with a sieve having a 1,410 μm-sieve opening. The coarse granules of 1,410 μm or more were pulverized by a Fitz Mill using powdery zeolite as an aid agent for pulverizing, and thereafter mixed with sieve-pass granules, to give base detergent granules.

PREPARATION EXAMPLE 4

Fifteen parts of zeolite 4A; 5 parts of sodium sulfate; 2 parts of sodium sulfite; and 2 parts of the same sodium polyacrylate as in Preparation Example 1 were mixed with water to prepare a slurry having a solid ingredient of 50% by weight (temperature: 58° C.). The resulting slurry was spray-dried by using a countercurrent flow type spray-dryer. The content of volatile matter of the particles was 2% (amount lost at 105° C. for 2 hours). Twenty parts of the same nonionic surfactant as in Preparation Example 1; 3 parts of the same polyethylene glycol as in Preparation Example 1; and 7 parts of palmitic acid were mixed with heating at 75° C. to prepare a liquid mixture. Subsequently, 25 parts of the above particles, 40 parts of crystalline silicate (pulverized product of SKS-6, average particle size: 17 μm), and 5 parts of amorphous aluminosilicate (average particle size: 10 μm, disclosed in Japanese Patent Laid-Open No. 6-179899) were introduced into a Lödige Mixer (manufactured by Matsuzaka Giken Co., Ltd., volume capacity: 20 L, equipped with a jacket), and the stirring with the main shaft (150 rpm) and the chopper (4,000 rpm) was started. The above liquid mixture was supplied to the mixer and was sprayed onto the powder mixture in 2.5 minutes, and thereafter stirred for 6 minutes. Further, 3 parts of the amorphous aluminosilicate was supplied as a surface-coating agent to the mixer, and the mixture was stirred for 1.5 minutes, to give base detergent granules. The entire charged amount was 4 kg.

PREPARATION EXAMPLE 5

Twenty-five parts of a sodium linear alkyl(10 to 13 carbon atoms)benzenesulfonate; 4 parts of a sodium alkyl(12 to 16 carbon atoms)sulfate; 2 parts of the same nonionic surfactant as in Preparation Example 1; 3 parts of a soap (14 to 20 carbon atoms); 12 parts of Zeolite P; 8 parts of No. 2 sodium silicate; 10 parts of sodium carbonate; 2 parts of potassium carbonate; 2 parts of sodium sulfate; 0.5 parts of sodium sulfite; 5 parts of the same acrylic acid-maleic acid copolymer as in Preparation Example 1; 1 part of the same polyethylene glycol as in Preparation Example 1; and fluorescent dyes (0.1 parts of Tinopal CBS-X and 0.1 parts of WHITEX SA) were mixed with water to prepare a slurry having a solid ingredient of 50% by weight (temperature: 65° C.). The resulting slurry was dried by using a countercurrent flow type spray-dryer to give particles having a bulk density of about 310 g/L. The content of volatile matter was 4% (amount lost at 105° C. for 2 hours). Thereafter, 78 parts of the particles and 3 parts of Zeolite P (average particle size: about 3 μm) were introduced into a High-Speed Mixer (manufactured by Fukae Powtec Corp., volume capacity: 25 L), and mixed. Subsequently, the resulting mixture was pulverized and granulated with stirring, while spraying 4 parts of a polyoxyethylene (average moles of EO: 6) alkyl (12 to 14 carbon atoms) ether. In this process, 5 parts of the above powdery zeolite was added for surface-coating immediately before the termination of the process, to give base detergent granules. The entire charged amount was 5 kg.

PREPARATION EXAMPLE 6

Twenty-five parts of a sodium linear alkyl(10 to 13 carbon atoms)benzenesulfonate; 4 parts of a sodium alkyl(12 to 16 carbon atoms)sulfate; 2 parts of a polyoxyethylene (average moles of EO: 6) alkyl(12 to 14 carbon atoms) ether; 3 parts of a soap (14 to 20 carbon atoms); 10 parts of zeolite 4A; 3 parts of No. 1 sodium silicate; 20 parts of sodium carbonate; 2 parts of potassium carbonate; 1 part of sodium sulfate; 0.5 parts of sodium sulfite; 5 parts of the same acrylic acid-maleic acid copolymer as in Preparation Example 1; 1 part of the same polyethylene glycol as in Preparation Example 1; and fluorescent dyes (0.1 parts of Tinopal CBS-X and 0.1 parts of WHITEX SA) were mixed with water to prepare a slurry having a solid ingredient of 50% by weight (temperature: 65° C.). The resulting slurry was dried by using a countercurrent flow type spray-dryer to give particles having a bulk density of about 310 g/L. The content of volatile matter was 4% (amount lost at 105° C. for 2 hours). Subsequently, 78 parts of the particles and 3 parts of zeolite 4A (average particle size: about 3 μm) were introduced into a High-Speed Mixer (manufactured by Fukae Powtec Corp., volume capacity: 25 L), and mixed. Thereafter, 5 parts of the same crystalline alkali metal silicate powders as in Preparation Example 3 were introduced into the mixer, and the mixture was further pulverized and granulated with stirring, with spraying 4 parts of the above nonionic surfactant thereto. In this process, 5 parts of the above powdery zeolite were added for surface-coating immediately before the termination of the process, to give base detergent granules. The entire charged amount was 5 kg.

PREPARATION EXAMPLE 7

Ten parts of a sodium linear alkyl(10 to 13 carbon atoms)benzenesulfonate, 15 parts of zeolite 4A, 7 parts of sodium carbonate, 5 parts of sodium sulfate, 2 parts of sodium sulfite, and 2 parts of the same sodium polyacrylate as in Preparation Example 1 (average molecular weight: 10,000) were mixed with water to prepare a slurry having a solid ingredient of 50% by weight (temperature: 58° C.). The resulting slurry was spray-dried by using a countercurrent flow type spray-dryer. The content of volatile matter of the particles was 2% (amount lost at 105° C. for 2 hours). Twenty parts of the same nonionic surfactant as in Preparation Example 6; 3 parts of the same polyethylene glycol as in Preparation Example 1; and 7 parts of palmitic acid were mixed with heating at 75° C. to prepare a liquid mixture. Subsequently, 30 parts of the above particles, 30 parts of the same crystalline alkali metal silicate as in Preparation Example 4, and 8 parts of the same amorphous aluminosilicate as in Preparation Example 4 were introduced into the same Lödige Mixer as in Preparation Example 4, and the stirring by the main shaft (150 rpm) and the chopper (4,000 rpm) was started. The above liquid mixture was supplied to the mixer over a period of 2.5 minutes, and thereafter stirred for 6 minutes. Further, 3 parts of amorphous aluminosilicate was supplied as a surface-coating agent to the mixer, and the mixture was stirred for 1.5 minutes, to give base detergent granules. The entire charged amount was 4 kg.

[Classification Procedures for Base Detergent Granules]

Classification procedures were carried out with each of the base detergent granules of Preparation Examples 1 to 7 using the classifier described above. Specifically, 100 g/batch of a sample was first supplied on a 2,000-μm sieve arranged at top of the classifier. Thereafter, the classifier was capped, and attached to a rotating and tapping shaker machine (manufactured by HEIKO SEISAKUSHO, tapping: 156 times/min, rolling: 290 times/min), and vibrated for 10 minutes. Thereafter, the samples remained on each of the sieves and a receiving tray were individually collected to obtain necessary amounts of samples of each group of the classified granules having sizes of 1,410 to 2,000 μm, 1,000 to 1,410 μm, 710 to 1,000 μm, 500 to 710 μm, 355 to 500 μm, 250 to 355 μm, 180 to 250 μm, 125 to 180 μm, and ones on the tray to 125 μm (less than 125 μm).

[Classification Procedures for Enzyme Granules]

The same classification procedures as those of the base detergent granules were carried out for Enzyme Granules A (manufactured by NOVO Nordisk, Savinase 18T Type W), to give each of the classified enzyme granules.

[Classification Procedures for Crystalline Alkali Metal Silicate]

The same classification procedures as those of the base detergent granules were carried out for Crystalline Alkali Metal Silicate B (manufactured by Clariant, SKS-6 granules), to give each of the classified enzyme granules.

[Determination of Dissolving Rate Vi of Each of Classified Granules]

The dissolving rate of each group of the classified granules was determined in accordance with the determination method described above. The results are shown in Table 1.

TABLE 1

| Vi | Prep. Ex. 1 | Prep. Ex. 2 | Prep. Ex. 3 | Prep. Ex. 4 | Prep. Ex. 5 | Prep. Ex. 6 | Prep. Ex. 7 | Enzyme A | Crystalline Alkali Metal Silicate B |
|---|---|---|---|---|---|---|---|---|---|
| V [1410–2000 μm] | 44.8 | 48.2 | 44.5 | 59.9 | 45.9 | 44.8 | 45.8 | — | — |
| V [1000–1410 μm] | 53.8 | 58.9 | 54.6 | 70.5 | 52.3 | 49.8 | 55.1 | 59.4 | — |
| V [710–1000 μm] | 64.1 | 67.8 | 61.5 | 84.3 | 65.1 | 64.0 | 64.4 | 74.4 | — |
| V [500–710 μm] | 77.6 | 82.3 | 78.3 | 97.6 | 79.8 | 77.6 | 78.5 | 81.3 | 85.6 |
| V [355–500 μm] | 95.4 | 98.2 | 96.8 | 99.7 | 96.4 | 95.2 | 96.1 | 95.0 | 88.1 |
| V [250–355 μm] | 99.6 | 99.6 | 99.5 | 99.8 | 99.4 | 98.7 | 99.5 | 99.7 | 94.5 |
| V [180–250 μm] | 100 | 100 | 100 | 100 | 100 | 99.8 | 100 | — | 99.8 |
| V [125–180 μm] | 100 | 100 | 100 | 100 | 100 | 100 | 100 | — | 99.9 |
| V [Less than 125 μm] | 100 | 100 | 100 | 100 | 100 | 100 | 100 | — | 100 |

TEST EXAMPLE 1

Detergent compositions were obtained using the classified granules of the base detergent granules of Preparation Examples 1 to 7, Enzyme Granules A or the crystalline alkali metal silicate by adjusting particle size distribution in accordance with the following process.

Operation 1 for Adjusting Particle Size Distribution

Each of the classified granules was weighed so that each sample weighs 200 g in accordance with a mass base frequency distribution of the particle size shown in Table 2, and each sample was mixed for 2 minutes by a rocking mixer (manufactured by Aichi Electronics Co., Ltd.) to prepare various detergent compositions of which particle size was adjusted.

The detergent compositions shown in Table 2 were evaluated in accordance with the Evaluations 1, 2 and 4. As a result, in the detergent compositions I (Examples 1 to 9, 12 and 13), it has been found that Examples 1, 4, 5, 8 and 12 satisfying the formula (A) of $\Sigma(Wi \cdot Vi) \geqq 95(\%)$ and having a mass base frequency of the classified granules having sizes of less than 125 μm of 0.1 or less were excellent in the dissolubility, the dispersibility and the hand-washing dissolubility. Also, in the detergent compositions II (Examples 10, 11 and 14), it has been found that Examples 10 and 14 satisfying the formula (B) of $\Sigma(Wi \cdot Vi) \geqq 97(\%)$ and having a mass base frequency of the classified granules having sizes of less than 125 μm of 0.08 or less were excellent in the dissolubility, the dispersibility and the hand-washing dissolubility. Further, when Example 10 and Example 14 were compared, Example 14 containing 5% by weight or more of an anionic surfactant comprising a sulfonate was evidently excellent in the dispersibility.

In addition, the detergency evaluation shown in Table 3 was carried out in accordance with Evaluation 3. As a result, the detergency of Examples 1, 4, 5, 8 and 12 that were excellent in the dissolubility, the dispersibility and the hand-washing dissolubility was higher in the detergent compositions I. Also, the detergency of Examples 10 and 14 that were excellent in the dissolubility, the dispersibility and the hand-washing dissolubility was higher in the detergent compositions II.

Further, Examples 1, 4, 8, 12 and 14 satisfying that an amount of sodium carbonate was from 1 to 15% by weight and a total amount of sodium carbonate and the alkali metal silicate was from 16 to 40% by weight was more excellent in the detergency.

TABLE 2

| | Ex. 1 | Ex. 2 | Ex. 3 | Ex. 4 | | Ex. 5 | Ex. 6 | Ex. 7 |
|---|---|---|---|---|---|---|---|---|
| Base Detergent Granules Used | Prep. Ex. 1 | Prep. Ex. 1 | Prep. Ex. 1 | Prep. Ex. 1 | Enzyme A | Prep. Ex. 2 | Prep. Ex. 2 | Prep. Ex. 2 |
| W [1410–2000 μm] | 0.00 | 0.01 | 0.00 | 0.00 | 0.00 | 0.01 | 0.01 | 0.00 |
| W [1000–1410 μm] | 0.00 | 0.02 | 0.00 | 0.00 | 0.00 | 0.02 | 0.10 | 0.00 |
| W [710–1000 μm] | 0.00 | 0.06 | 0.00 | 0.01 | 0.01 | 0.06 | 0.22 | 0.02 |
| W [500–710 μm] | 0.01 | 0.07 | 0.02 | 0.04 | 0.02 | 0.07 | 0.26 | 0.03 |
| W [355–500 μm] | 0.13 | 0.16 | 0.07 | 0.21 | 0.00 | 0.16 | 0.17 | 0.11 |
| W [250–355 μm] | 0.40 | 0.40 | 0.14 | 0.33 | 0.00 | 0.40 | 0.11 | 0.18 |
| W [180–250 μm] | 0.40 | 0.18 | 0.28 | 0.31 | 0.00 | 0.18 | 0.06 | 0.24 |
| W [125–180 μm] | 0.04 | 0.08 | 0.33 | 0.04 | 0.00 | 0.08 | 0.04 | 0.26 |
| W [Less than 125 μm] | 0.02 | 0.02 | 0.16 | 0.03 | 0.00 | 0.02 | 0.03 | 0.16 |
| Average Particle Size [μm] | 259 | 303 | 182 | 284 | | 303 | 565 | 201 |
| Bulk Density [g/L] | 773 | 770 | 731 | 775 | | 821 | 839 | 788 |
| Flowability [sec] | 6.3 | 6.8 | >10 | 6.4 | | 6.8 | 6.4 | >10 |
| Σ (Wi · Vi) [%] | 99 | 93.9 | 99.3 | 97.0 | | 95.0 | 83.3 | 98.6 |
| Evaluation 1 | A | C | A | A–B | | B | D | A |
| Evaluation 2 | I | II | IV | I | | II | I | IV |
| Evaluation 4 [sec] | 36 | 118 | 31 | 68 | | 95 | 250 | 42 |

| | | | | | Ex. 12 | | | |
|---|---|---|---|---|---|---|---|---|
| Base Detergent | Ex. 8 Prep. | Ex. 9 Prep. | Ex. 10 Prep. | Ex. 11 Prep. | Prep. | Crystalline Alkali Metal | Ex. 13 Prep. | Ex. 14 Prep. |

TABLE 2-continued

| Granules Used | Ex. 3 | Ex. 3 | Ex. 4 | Ex. 4 | Ex. 5 | Silicate B | Ex. 6 | Ex. 7 |
|---|---|---|---|---|---|---|---|---|
| W [1410–2000 μm] | 0.00 | 0.00 | 0.00 | 0.00 | 0.00 | 0.00 | 0.00 | 0.00 |
| W [1000–1410 μm] | 0.00 | 0.09 | 0.00 | 0.04 | 0.00 | 0.00 | 0.00 | 0.00 |
| W [710–1000 μm] | 0.04 | 0.20 | 0.03 | 0.14 | 0.00 | 0.00 | 0.00 | 0.00 |
| W [500–710 μm] | 0.09 | 0.19 | 0.10 | 0.15 | 0.02 | 0.02 | 0.01 | 0.01 |
| W [355–500 μm] | 0.25 | 0.14 | 0.26 | 0.16 | 0.18 | 0.02 | 0.08 | 0.07 |
| W [250–355 μm] | 0.23 | 0.12 | 0.30 | 0.16 | 0.36 | 0.01 | 0.22 | 0.41 |
| W [180–250 μm] | 0.19 | 0.08 | 0.21 | 0.13 | 0.34 | 0.00 | 0.29 | 0.44 |
| W [125–180 μm] | 0.10 | 0.08 | 0.08 | 0.13 | 0.04 | 0.00 | 0.26 | 0.05 |
| W [Less than 125 μm] | 0.10 | 0.10 | 0.02 | 0.09 | 0.01 | 0.00 | 0.14 | 0.02 |
| Average Particle Size [μm] | 296 | 476 | 312 | 347 | 277 | | 202 | 248 |
| Bulk Density [g/L] | 772 | 769 | 873 | 890 | 752 | | 781 | 779 |
| Flowability [sec] | 6.7 | 6.9 | 6.0 | 6.1 | 6.8 | | >10 | 6.3 |
| Σ (Wi · Vi) [%] | 95.6 | 83.6 | 99.2 | 96.2 | 99.1 | | 99.0 | 99.3 |
| Evaluation 1 | B | D | A | B | A | | A | A |
| Evaluation 2 | II | II | II | IV | I | | IV | I |
| Evaluation 4 [sec] | 90 | 282 | 29 | 75 | 34 | | 46 | 29 |

TABLE 3

| | Ex. 1 | Ex. 2 | Ex. 3 | Ex. 4 | | Ex. 5 | Ex. 6 | Ex. 7 | Ex. 8 | Ex. 9 | Ex. 10 | Ex. 11 | Ex. 12 | | Ex. 13 | Ex. 14 |
|---|---|---|---|---|---|---|---|---|---|---|---|---|---|---|---|---|
| | | | | | | | | | | | | | | Crystalline | | |
| Base Detergent Granules Used | Prep. Ex. 1 | Prep. Ex. 1 | Prep. Ex. 1 | Prep. Ex. 1 | Enzyme A | Prep. Ex. 2 | Prep. Ex. 2 | Prep. Ex. 2 | Prep. Ex. 3 | Prep. Ex. 3 | Prep. Ex. 4 | Prep. Ex. 4 | Prep. Ex. 5 | Alkali Metal Silicate B | Prep. Ex. 6 | Prep. Ex. 7 |
| Evaluation 3 | 54 | 46 | 42 | 55 | | 48 | 44 | 41 | 52 | 43 | 52 | 41 | 54 | | 37 | 56 |

TEST EXAMPLE 2

Each of the high-density detergent compositions was obtained using the classified granules of the base detergent granules (1) of Preparation Example 1 by adjusting particle size distribution in accordance with the following process.

Operation 2 for Adjusting Particle Size Distribution

One-hundred parts of the base detergent granules (1) obtained in Preparation Example 1 were classified by a gyratory screen (manufactured by Tokuju Kosakusho) having a screen having a 500 μm-sieve opening. The sieve-on granules were removed to give 55.3 parts of the detergent composition of Example 15.

Operation 3 for Adjusting Particle Size Distribution

The amount 55.3 parts of the detergent composition of Example 15 was introduced as base detergent granules into a gyratory screen having a screen having a 125 μm-sieve opening to remove fine powder having a size of less than 125 μm, thereby giving 51.5 parts of the detergent composition of Example 16.

Operation 4 for Adjusting Particle Size Distribution

In the same manner as in Operation 2 for adjusting particle size distribution, 100 parts of the base detergent granules (1) obtained in Preparation Example 1 were introduced into a gyratory screen having a screen having a 500 μm-sieve opening, and classified into sieve-on granules A and sieve-pass granules A, wherein the weights thereof were 44.7 parts and 55.3 parts, respectively. The amount 44.7 parts of the sieve-on granules A and 2 parts of powdery zeolite (average particle size: 3 μm) as an aid agent for pulverization were fed into a Fitz Mill (manufactured by Hosokawa Micron Corporation) with cooling air, to give a first-step pulverized granules. Thereafter, the first-step pulverized granules were fed into the second step of the Fitz Mill to give second-step pulverized granules. The opening of the screen of the Fitz Mill for the first-step had a diameter of 2 mm and that for the second-step had a diameter of 1 mm. The average particle size of the second-step pulverized granules was 376 μm. Of the 48.7 parts of the second-step pulverized granules, granules having a size of 500 μm or more occupied 23.2 parts. The second-step pulverized granules were introduced into the above gyratory screen having a screen having a 500 μm-sieve opening, and classified into sieve-on granules B and sieve-pass granules B. The amount 25.5 parts of sieve-pass granules B and 55.3 parts of the sieve-pass granules A were blended to give 80.8 parts of the detergent composition of Example 17.

Operation 5 for Adjusting Particle Size Distribution

The amount 80.8 parts of the detergent composition of Example 17 was introduced into the above gyratory screen having a screen having a 125 μm-sieve opening to remove fine powder having a size of less than 125 μm, thereby giving 76.0 parts of the detergent composition of Example 18.

Operation 6 for Adjusting Particle Size Distribution

The amount 80.8 parts of the detergent composition of Example 17 was introduced into a gyratory screen having a screen having a 180 μm-sieve opening, and classified into sieve-on granules C and sieve-pass granules C. The weights of the sieve-on granules C and the sieve-pass granules C were 65.4 parts and 15.4 parts, respectively.

The sieve-pass granules C were granulated according to the following procedures. The amount 15.4 parts of the sieve-pass granules C was introduced into the above High-Speed Mixer, and 0.77 parts of the above nonionic surfactant was sprayed thereto over a period of 1.3 minutes. Thereafter, the mixture was granulated with stirring for 10 minutes. Subsequently, the resulting granules were subjected to a surface-coating treatment for 1 minute by adding 0.92 parts of zeolite (average particle size: about 3 μm), to give base detergent granules (2) (average particle size: 662 μm). The base detergent granules were classified into sieve-on granules A' and sieve-pass granules A' using a gyratory screen having a 500 μm-sieve opening. The sieve-on granules A' were subjected to two-step pulverizing, the same method as used in Operation 4, using a Fitz Mill to classify the resulting pulverized granules into sieve-on granules B' and sieve-pass granules B' using a gyratory screen having a 500 μm-sieve opening. Thereafter, the sieve-pass granules B', the sieve-pass granules A' and the sieve-pass granules C were blended to give 80.0 parts of the detergent composition of Example 19.

Each of the detergent compositions shown in Table 4 was evaluated in accordance with the Evaluations 1, 2 and 4. As a result, it has been found that Examples 15 to 19 were excellent in the dissolubility, the dispersibility and the hand-washing dissolubility. Here, it has been found that Examples 16, 18, and 19 having a low mass base frequency of the classified granules having sizes of less than 125 μm were particularly excellent in the dispersibility. In addition, the detergency evaluation shown in Table 5 was carried out in accordance with the Evaluation 3. As a result, it has been found that Examples 15 to 19, which were excellent in the dissolubility and the dispersibility, were also excellent in the detergency.

TABLE 4

| Base Detergent Granules Used | Ex. 15 Prep. Ex. 1 | Ex. 16 Prep. Ex. 1 | Ex. 17 Prep. Ex. 1 | Ex. 18 Prep. Ex. 1 | Ex. 19 Prep. Ex. 1 |
|---|---|---|---|---|---|
| W [1410–2000 μm] | 0.00 | 0.00 | 0.00 | 0.00 | 0.00 |
| W [1000–1410 μm] | 0.00 | 0.00 | 0.00 | 0.00 | 0.00 |
| W [710–1000 μm] | 0.00 | 0.00 | 0.00 | 0.00 | 0.00 |
| W [500–710 μm] | 0.00 | 0.00 | 0.00 | 0.00 | 0.00 |
| W [355–500 μm] | 0.14 | 0.15 | 0.30 | 0.30 | 0.30 |
| W [250–355 μm] | 0.31 | 0.34 | 0.28 | 0.32 | 0.36 |
| W [180–250 μm] | 0.31 | 0.33 | 0.24 | 0.24 | 0.29 |
| W [125–180 μm] | 0.17 | 0.18 | 0.13 | 0.14 | 0.04 |
| W [Less than 125 μm] | 0.07 | 0.00 | 0.05 | 0.00 | 0.01 |
| Average Particle Size [μm] | 237 | 248 | 276 | 285 | 292 |
| Bulk Density [g/L] | 701 | 730 | 715 | 708 | 704 |
| Flowability [sec] | 7.3 | 6.5 | 6.7 | 6.2 | 6.3 |
| Σ (Wi · Vi) [%] | 99.2 | 99.2 | 98.5 | 98.5 | 98.5 |
| Evaluation 1 | A | A | A | A | A |
| Evaluation 2 | II | I | I | I | I |
| Evaluation 4 [sec] | 27 | 29 | 38 | 48 | 55 |

TABLE 5

| Base Detergent Granules Used | Ex. 15 Prep. Ex. 1 | Ex. 16 Prep. Ex. 1 | Ex. 17 Prep. Ex. 1 | Ex. 18 Prep. Ex. 1 | Ex. 19 Prep. Ex. 1 |
|---|---|---|---|---|---|
| Evaluation 3 | 56 | 58 | 55 | 57 | 59 |

TEST EXAMPLE 3

The data on the dissolubility of the granules and the hand-washing dissolubility for 17 kinds of commercial products of representative detergent compositions sold in Japan and elsewhere are shown in Table 6.

It is clear from the results shown in Table 6 that these marketed detergents are low in level of the dissolubility of the granules, and also poor in the hand-washing dissolubility.

TABLE 6

| | Σ (Wi · Vi) [%] | Time Period of hand-washing solution [s] |
|---|---|---|
| Japan | | |
| Marketed Detergent A | 88.8 | 160 |
| Marketed Detergent B | 83.7 | 185 |
| Marketed Detergent C | 93.4 | 131 |
| Marketed Detergent D | 83.8 | 205 |
| Marketed Detergent E | 89.5 | 178 |
| Marketed Detergent F | 91.7 | 168 |
| Marketed Detergent G | 84.2 | 202 |
| Marketed Detergent H[1)] | 95.4 | 152 |
| Europe and America | | |
| Marketed Detergent I | 94.0 | 119 |
| Marketed Detergent J | 90.9 | 173 |
| Marketed Detergent K | 92.5 | 172 |
| Marketed Detergent L | 93.8 | 185 |
| Asia and Oceania | | |
| Marketed Detergent M | 81.2 | 227 |
| Marketed Detergent N | 84.1 | 245 |
| Marketed Detergent O | 74.5 | 155 |
| Marketed Detergent P | 80.1 | 190 |
| Marketed Detergent Q | 91.7 | 232 |

[1)]Anionic surfactant: nonionic surfactant = 2:21

INDUSTRIAL APPLICABILITY

The detergent composition of the present invention rapidly dissolves after supplying to water, even with cold water, is excellent in the dispersibility owing to agglomeration of the granules, and is excellent in detergency such that the detergent composition exhibits excellent dissolubility and detergency under washing conditions of low-mechanical power as employed in recent washing machines, and further even under washing conditions such as hand-washing.

EQUIVALENT

Those skilled in the art will recognize, or be able to ascertain using simple routine experimentation, many equivalents to the specific embodiments of the invention described in the present specification. Such equivalents are intended to be encompassed in the scope of the following claims.

The invention claimed is:

1. A high-density detergent composition comprising 10 to 60% by weight of a surfactant composition having a weight ratio of an anionic surfactant to a nonionic surfactant of 4:10 or more and 10:0 or less, wherein said surfactant composition comprises an alkali metal silicate and also comprises 15% or less by weight of sodium carbonate, wherein the high-density detergent composition has a bulk density of from 600 to 1200 g/L, and has a total summation of a product of a mass base frequency Wi and a dissolving rate Vi which satisfies the following formula (A):

$$\Sigma(Wi \cdot Vi) \geqq 95(\%) \quad (A)$$

of each group of classified granules obtained by classifying detergent granules by using a classifier, wherein a mass base frequency Wi of the classified granules having a size of less than 125 μm is 0.1 or less and a mass base frequency Wi of the classified granules having a size of more than 710 μm and less than 1000

μm is 0.1 or less and each mass base frequency Wi satisfies the relationship such that the mass base frequency of [classified granules having a particle size of 1000 μm or more]≦[classified granules having a particle size of 710 μm or more and less than 1000 μm]≦[classified granules having a particle size of 500 μm or more and less than 710 μm] when the granules are classified with a classifier that comprises a series of sieves having sieve-openings respectively of 2000 μm, 1410 μm, 1000 μm, 710 μm, 500 μm, 355 μm, 250 μm, 180 μm, and 125 μm, and a receiver, wherein the mass base frequency Wi is obtained by dividing the weight of the classified granules on each sieve or on the receiver by an entire weight of the detergent composition, and wherein the dissolving rate Vi is determined under the following measurement conditions: supplying 1.000 g±0.010 g of a sample to 1.00 L±0.03 L of water at 5° C.±0.5° C. having a water hardness of 4° DH, stirring in a 1 L beaker of which inner diameter is 105 mm, with a cylindrical stirring rod of which length is 35 mm and diameter is 8 mm, at a rotational speed of 800 rpm for 120 seconds, and thereafter filtering insoluble remnants by a standard sieve having a sieve-opening of 300 μm as defined according to JIS Z 8801, wherein the dissolving rate Vi of the classified granules is calculated by the following formula (a), i being each group of the classified granules:

$$Vi=(1-Ti/Si)\times 100(\%) \quad (a)$$

wherein Si is a weight (g) of each group of the classified granules supplied; and Ti is a dry weight (g) of the insoluble remnants of each group of the classified granules remaining on the sieve after filtration.

2. A high-density detergent composition as in claim 1, wherein the counterions in said anionic surfactant comprise 5% by weight or more potassium counterions.

3. A high-density detergent composition as in claim 2, wherein said anionic surfactant comprises 1 to 50% by weight of said detergent composition.

4. A high-density detergent composition as in claim 3, wherein said anionic surfactant comprises 5 to 30% by weight of said detergent composition.

5. A high-density detergent composition as in claim 1, wherein said nonionic surfactant is a polyoxyethylene-polyoxypropylene-polyoxyethylene alkyl ether.

6. A high-density detergent composition as in claim 1, wherein a total sum of the sodium carbonate and the alkali metal silicate is 19% or more by weight of the detergent composition.

7. The high-density detergent composition of claim 1, wherein the alkali metal silicate comprises $SiO_2$ and $M_2O$, wherein M represents an alkali metal atom, and the $SiO_2/M_2O$ mole ratio in said alkali metal silicate is from 0.5 to 2.6.

8. The high-density detergent composition of claim 1, wherein said alkali metal silicate is crystalline.

9. The high-density detergent composition of claim 1, wherein said alkali metal silicate is represented by formula (I) or formula (II):

$$x(M_2O).y(SiO_2).z(Me_mO_n).w(H_2O) \quad (I)$$

$$M_2O.x'(SiO_2).y'(H_2O) \quad (II)$$

wherein, in formula (I) M stand for an element in Group IA of the Periodic Table, Me stand for one or more elements selected from Group IIA elements, Group IIB elements, Group IIIA elements, Group IVA elements, and Group VIII elements of the Periodic Table, y/x is from 0.5 to 2.6, z/x is from 0.001 to 1.0, w is from 0 to 20, and n/m is from 0.5 to 2.0, and in formula (II) M stands for an alkali metal, x' is from 1.5 to 2.6, and y' is from 0 to 20.

10. The high-density detergent composition of claim 1, wherein said anionic surfactant comprises 1 to 50% by weight of said detergent composition, and wherein said surfactant composition comprises 0.5 to 40% by weight of a crystalline silicate.

11. A process for preparing the high-density detergent composition of claim 1 comprising subjecting unclassified detergent granules comprising 10 to 60% by weight of a surfactant composition, having a weight ratio of anionic surfactant to nonionic surfactant of 4:10 or more and 10:0 or less, to classification operation; and adjusting a particle size of each group of the resulting classified granules, such that the formula (A) is satisfied, and such that a mass based frequency of the classified granules having a size of less than 125 μm is 0.1 or less.

* * * * *